US006517726B2

(12) United States Patent
Allen et al.

(10) Patent No.: US 6,517,726 B2
(45) Date of Patent: Feb. 11, 2003

(54) CONTAMINANT SLICK DISPERSAL APPARATUS AND METHODS

(75) Inventors: Alan A. Allen, Woodinville, WA (US); Jeffery D. Cantrell, Crossville, IL (US)

(73) Assignee: American Marine, Inc., Cocoa, FL (US)

( * ) Notice: Subject to any disclaimer, the term of this patent is extended or adjusted under 35 U.S.C. 154(b) by 92 days.

(21) Appl. No.: 09/847,491

(22) Filed: May 2, 2001

(65) Prior Publication Data

US 2001/0035381 A1 Nov. 1, 2001

Related U.S. Application Data

(60) Provisional application No. 60/201,201, filed on May 2, 2000.

(51) Int. Cl.[7] ..... C02F 1/00

(52) U.S. Cl. ..... 210/749; 210/198.1; 210/242.3; 210/923; 210/925

(58) Field of Search ..... 210/749, 153, 210/198.1, 242.1, 242.3, 922, 923, 925

(56) References Cited

U.S. PATENT DOCUMENTS

| | | | | |
|---|---|---|---|---|
| 3,710,943 A | | 1/1973 | Davidson et al. | 210/242 |
| 3,862,904 A | | 1/1975 | Weatherford | 210/242 |
| 4,126,547 A | | 11/1978 | Kuris | 210/19 |
| 4,145,290 A | * | 3/1979 | Nagy et al. | |
| 4,295,756 A | | 10/1981 | Blair | 405/70 |
| 4,342,655 A | * | 8/1982 | Webb | |
| 4,388,188 A | | 6/1983 | Morris | 210/242.3 |
| 4,392,957 A | | 7/1983 | Webb | 210/241 |
| 4,437,630 A | | 3/1984 | Jefferies | 244/136 |
| 5,108,600 A | * | 4/1992 | Rees et al. | |
| 5,618,468 A | | 4/1997 | Canevari et al. | 252/354 |
| 5,728,320 A | | 3/1998 | Fiocco et al. | 252/312 |
| RE35,906 E | | 9/1998 | Sanders | 43/6.5 |
| 5,810,512 A | | 9/1998 | Kateley | 405/64 |
| 5,863,440 A | | 1/1999 | Rink et al. | 210/693 |
| 5,871,305 A | | 2/1999 | Allen | 405/70 |
| 5,885,451 A | | 3/1999 | Porrovecchio, Sr. | 210/242.4 |
| 5,961,825 A | | 10/1999 | Love | 210/238 |
| 6,024,512 A | | 2/2000 | Mosley | 405/65 |
| 6,073,382 A | | 6/2000 | Willener | 43/4.5 |
| 6,099,723 A | | 8/2000 | Morris et al. | 210/170 |
| 6,120,681 A | | 9/2000 | Heo | 210/86 |
| 6,143,172 A | | 11/2000 | Rink et al. | 210/237 |
| 6,174,436 B1 | | 1/2001 | Kim | 210/242.3 |
| 6,190,570 B1 | | 2/2001 | Nakamura et al. | 210/776 |

FOREIGN PATENT DOCUMENTS

| | | |
|---|---|---|
| CA | 1185581 | 4/1985 |
| EP | 0 253 514 A1 | 1/1988 |
| GB | 2 107 267 A | 4/1983 |

(List continued on next page.)

OTHER PUBLICATIONS

"Neat Sweep—New Concept in Dispersant Application," *www.elastec.com/neat.html*, Apr. 2001, entire page.

"Used 65' Custom Chris White Catamaran For Sale," *www.2hulls.com/usedcatamaran2000/fishead.html*, p. 1, p. 3 line 3.

*Primary Examiner*—Betsey Morrison Hoey
(74) *Attorney, Agent, or Firm*—Woodard, Emhardt, Naughton, Moriarty & McNett

(57) ABSTRACT

Method and apparatus for depositing a chemical over a body of water. In one embodiment the invention includes collecting and concentrating a floating contaminant between two floating booms pulled by one or more surface vessels. The booms define an aperture intermediate of their endpoints, and the towing of the boom results in the flow of concentrated contaminant through the aperture. One or more nozzles proximate the aperture deposit a chemical, such as a liquid dispersant, on the contaminant and water flowing through the aperture. Some embodiments also include a mixing apparatus placed at aft of the aperture for inducing mixing of the deposited chemical and the floating contaminant.

29 Claims, 6 Drawing Sheets

FOREIGN PATENT DOCUMENTS

| | | |
|---|---|---|
| GB | 2 206 814 A | 1/1989 |
| GB | 2 275 893 A | 9/1994 |
| GB | 2 278 553 A | 12/1994 |
| GB | 2 351 947 A | 1/2001 |
| JP | 11-247166 | 9/1999 |
| JP | 2000-170143 | 6/2000 |
| WO | WO 94/28254 | 12/1994 |
| WO | WO 98/34722 | 8/1998 |
| WO | WO 99/05366 | 2/1999 |
| WO | WO 99/35340 | 7/1999 |
| WO | WO 00/27694 | 5/2000 |
| WO | WO 00/29506 | 5/2000 |
| WO | WO 00/34589 | 6/2000 |
| WO | WO 00/65157 | 11/2000 |

* cited by examiner

CONTAMINANT SLICK DISPERSAL APPARATUS AND METHODS

This application claims the benefit of priority to U.S. Provisional Patent Application No. 60/201,201, filed May 2, 2000, which is incorporated herein by reference.

FIELD OF THE INVENTION

The present invention relates to apparatus and methods for applying a chemical on a body of water or a contaminant from a water vessel, and more specifically to apparatus and methods for applying a dispersant chemical on a floating contaminant collected within a towed boom.

BACKGROUND OF THE INVENTION

There are various methods for responding to contamination, such as an oil slick floating on the water. These methods include containing the contaminant with floating booms, removing the contaminant by any of various methods or apparatus such as burning the contaminant, dispersing the contaminant, and other methods.

One method of dispersing floating contaminant such as an oil slick involves spreading a chemical dispersant on the contaminant which induces the contaminant to break apart more easily. Currently several methods are known for spraying chemical dispersant. For example, the chemical can be sprayed on the oil slick by a helicopter or airplane. This method may require the use of multiple aircraft, because of the limitation of the aircraft with regards to the weight of chemical that can be carried. Yet another method of distributing a chemical dispersant involves the placement of booms on either side of a boat. The booms contain a plurality of spray nozzles which spray the chemical dispersant downward upon the surface of the water. Although, the use of a surface vessel permits much more dispersant to be carried, the surface area over which the dispersant can be distributed is limited by the short length of the booms.

What is needed are methods and apparatus which overcome the drawbacks of currently used methods. The present invention overcomes these drawbacks in novel and unobvious ways.

SUMMARY OF THE INVENTION

One embodiment of the present invention is a unique method for chemically treating a substance floating on a body of water. Other embodiments include unique apparatus, methods, systems, and devices to distribute a chemical on a substance floating on a body of water.

A further embodiment of the present invention pertains to a method for concentrating a floating contaminant on a body of water, and treating that contaminant with a chemical. In some embodiments, the concentrating is accomplished with a floating boom assembly in a contaminated section of a body of water. Some embodiments of the present invention include shaping the boom to have an apex, and distributing the chemical onto the concentrated contaminant that is proximate the apex.

Still another embodiment of the present invention includes towing a boom assembly over a body. The boom assembly includes an opened end which is pulled by one or more water vessels, and further includes a flow aperture through which the surface water between the arms of the boom flows. In some embodiments, the boom includes one or more nozzles near the flow aperture which direct a quantity of the chemical at the surface of the water.

Yet another embodiment of the present invention includes a floating apparatus which is towed by a water vessel. The floating apparatus includes a pair of opposing vertical sides which float in the water. The sides are spaced apart to form a flow channel through which surface water flows. One or more cross members attached at either end to the opposing sides that span the channel. One or more of the cross members include at least one nozzle which sprays a chemical onto any liquids floating through the channel.

A still further embodiment of the present invention includes a pair of floating platforms, a first floating platform being towed behind a water vessel, and a second floating platform being towed behind the first floating platform. The first floating platform includes at least one nozzle for spraying a chemical onto floating contaminant, the surface of the water, or any objects floating proximate to the first floating platform. The combination of the deposited chemical and the floating contaminant, surface water, or floating object are received by a mixing apparatus on the second floating platform. The mixing apparatus induces turbulence in the water and enhances the mixing of the deposited chemical with the floating contaminant, surface water, or floating object.

Further objects, embodiments, forms, benefits, aspects, features and advantages of the present invention can be obtained from the description, drawings, and claims provided herein.

DESCRIPTION OF THE PREFERRED EMBODIMENT

Figure 1:
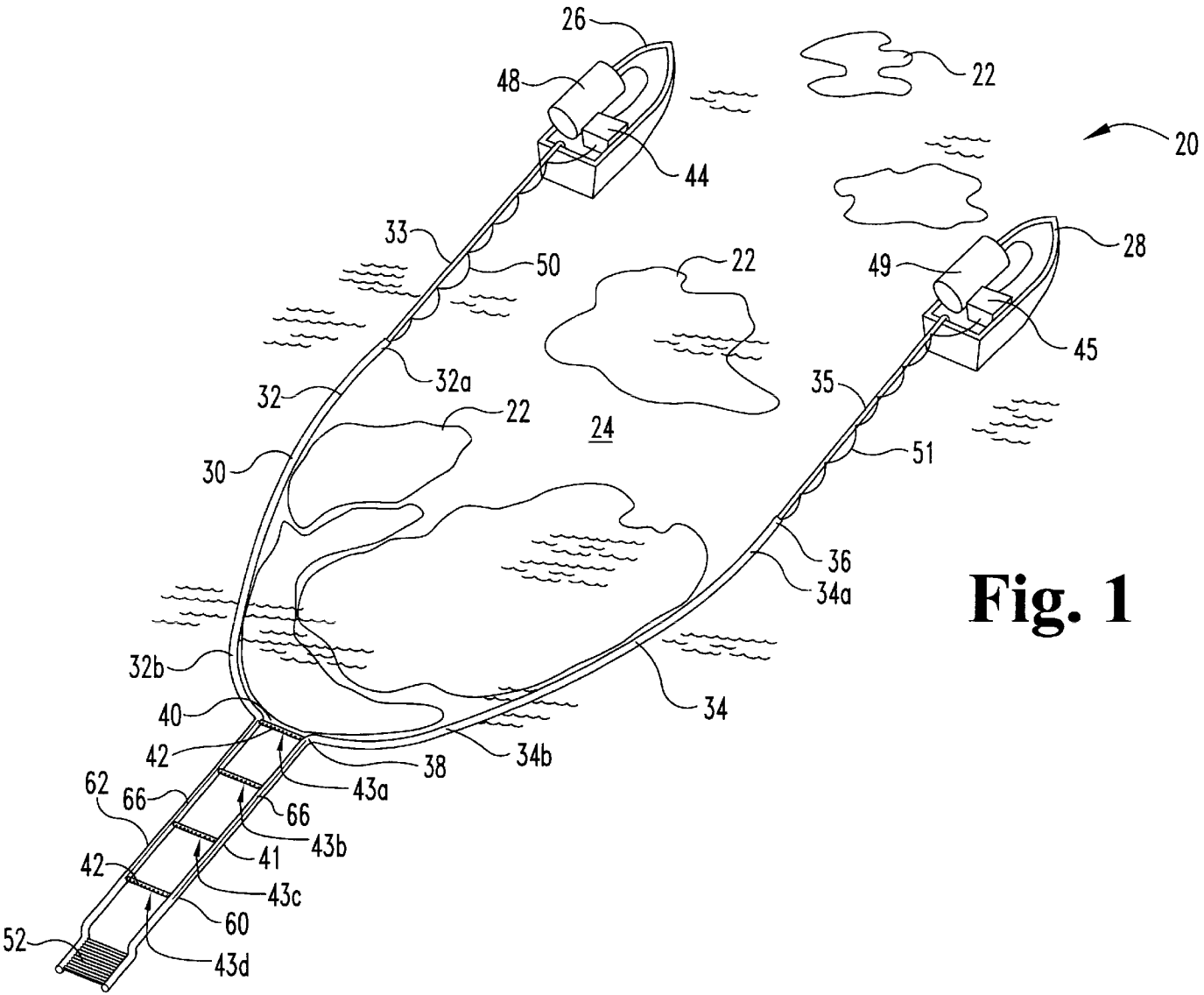
FIG. 1 is a view from above of one embodiment according to the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention includes apparatus and methods for applying a chemical onto a body of water. Some embodiments of the present invention more specifically relate to apparatus and methods for applying a chemical dispersant onto a contaminant such as oil floating on a body of water such as a river, lake, or ocean. In one embodiment, the contaminant is concentrated or collected between opposing sides of a towed floating boom. The boom is towed across the body of water by one or more water vessels. The boom is shaped with an open end in which the floating contaminant is concentrated or collected and with an open apex at which the floating contaminant is further concentrated, treated and released. Located near the apex of the boom is at least one nozzle for spraying a chemical dispersant onto the contaminant. The combination of contaminant and chemical dispersant are then released from an aperture near the apex back into a mixing apparatus and onto the body of water where the contaminant disperses. The present invention also contemplates those embodiments in which other types of chemicals are deposited on a body of water, or on a substance floating on a body of water.

Another embodiment of the present invention includes a floating platform or spraying section which is preferably towed by the boom and placed aft of the aperture at the apex of the boom. The concentrated contaminant near the apex flows through the aperture and into the spraying section as the spraying section is towed through the water. The contaminant flowing through the spraying section is deposited with chemical dispersant from one or more of nozzles. In one embodiment, the nozzles are directed generally downward toward the surface of the water. In yet other embodiments, the direction of spray is both downward and also lateral relative to the flow water. Also, the present invention contemplates those embodiments in which the nozzles are suspended slightly below the surface of the water and are pointed generally upward. In some embodiments of the present invention, the spraying nozzles are anywhere from about 50 feet aft of the towing vessel to about 1000 feet aft of the towing vessel. By placing the nozzles downstream a distance from the towing vessel, there is little or no exposure of the airborne chemical dispersant to any personnel on the vessel.

In some embodiments of the present invention the chemical dispersant is pumped to the nozzles so as to facilitate distribution of the dispersant and improved coverage of the chemical dispersant on the contaminant. The present invention contemplates those embodiments in which chemical dispersant is sprayed at any pressure. Further, the present invention contemplates spraying of any type of chemical on the body of water, contaminant, or substance floating on the body of water, including liquid, solid, and gaseous chemicals.

In yet another embodiment of the present invention, a mixer is located aft of the spraying section. The mixer receives the combination of contaminant and sprayed chemical dispersant and agitates the combination to improve mixing of the chemical dispersant throughout the contaminant, and thereby improve the dispersal of the contaminant. As non-limiting examples, one embodiment of the present invention contemplates a mixer that includes a planar surface with surface roughening features that induce mixing and turbulence as the mixer is towed through the water. Other non-limiting examples of a mixer include wooden pallets, which induce mixing and turbulence because of the alternating and spaced apart arrangement of the wooden slats. In yet another embodiment, the mixer is a flexible plastic sheath with a plurality of holes.

FIG. 1 shows a view from above of one embodiment of the present invention. An apparatus 20 is provided on a body of water 24 which includes sections of floating contaminant 22, such as oil. Apparatus 20 includes a first water vessel 26 and a second water vessel 28 towing a boom 30. Boom 30 includes a first boom portion 32 and a second boom portion 34 which are preferably opposite each other. First vessel 26 pulls first boom portion 32 over body of water 24 by a first tension line 33. Second water vessel 28 pulls second boom portion 34 over body of water 24 by a second tension line 35. Water vessels 26 and 28 are spaced apart and preferably guided along parallel paths such that the boom portions 32 and 34 form an open end between boom ends 36*a* and 36*b* for collecting concentrated contaminant therebetween. The present invention allows for one or two boats pulling the system on a body of water.

Boom portions 32 and 34 interconnect proximate an apex 38, apex 38 being formed as a result of the forward motion and parallel directions of water vessels 26 and 28. Alternatively, the present invention also contemplates boom portions 32 and 34 that are opposite-facing portions of a continuous section of boom 30. Towing of boom 30 over body of water 24 by vessels 26 and 28 collects and concentrates a portion of contaminant 22 from body of water 24 into the area between boom portions 32 and 34. To facilitate collecting the contaminant, boom portions 32 and 34 include leading portions 32*a* and 34*a*, respectively. Leading sections 32*a* and 34*a* preferably have a shallow draft to facilitate concentration of contaminant while also minimizing drag on boom 30. Aft boom sections 32*b* and 34*b* of boom portions 32 and 34, respectively, have a deeper draft and include a standard skirt size. As non-limiting examples, the draft boom can be from 6 inches to 24 inches depending upon the requirements of the specific application. Yet other embodiments of the present invention include a boom 30 with a relatively constant draft. Preferably, boom portions 32 and 34 are inflatable, although the present invention contemplates the use of any type of boom.

Located approximately in the center of apex 38 is an aperture 40. The towing of boom portions 32 and 34 directs the concentrated and collected contaminant toward apex 38. The concentrated contaminant collected proximate the apex flows through aperture 40. A floating platform or spraying section 41 is preferably located aft of aperture 40 and receives the concentrated contaminant flowing through aperture 40. A floating platform 41 preferably includes a pair of generally opposing side members 60 and 62. Side members 60 and 62 are preferably spaced apart by about 10 feet. This distance between the spaced apart side members 60 and 62 form opposing walls of aperture 40. Side members 60 and 62 preferably have sufficient buoyancy to support the cross members, spray nozzles, and manifolds attached thereto. Preferably side members 60 and 62 have a top surface which is several feet above the surface of the water.

A plurality of nozzles 42 placed within floating platform or spraying section 41 sprays the chemical dispersant on the contaminant. In one embodiment, spraying section 41 is about 25 feet wide, and includes four cross members or spray arms 43*a*, 43*b*, 43*c*, and 43*d*. In another embodiment, spraying section 41 is about 10 feet wide and includes three cross members (as best seen in FIGS. 6 and 7, which will be described later). Spray arms 43*a*–43*d* are oriented transverse to the flow of the contaminant through spraying section 41. A floating platform or spraying section 41 preferably includes at least one cross member which is attached at either end to one of the sides of the floating platform. The cross member preferably spans the predetermined distance between the sides. In other embodiments, there are multiple cross members spanning the predetermined distance between sides of floating platform 41.

Each cross member or spray arm 43*a*–43*d* includes a plurality of nozzles 42. The nozzles of the cross members are preferably hydraulically interconnected by one or more manifolds 66 (similar to manifolds 266, which are best seen in FIG. 6), the manifolds being provided pressurized chemical by a pump 44. Preferably, nozzles 42 spray the chemical dispersant generally toward the water flowing through aperture 40, preferably such as in a conical pattern. Preferably, the nozzles 42 are of a low pressure design (about 80 psi supply pressure), although the present invention contemplates higher pressure nozzles, including nozzles provided a supply pressure of more than 600 psi. The present invention contemplates any type of nozzle including nozzles generally used for agricultural spraying applications, orifice disk-type nozzles, flat "V" nozzles, vee jet flat spray nozzles such as those made by Delevan, and other types of nozzles. By placing the nozzles within a few feet of the surface of the water and directing the nozzle spray toward the surface of the water, it is possible to reduce the amount of dispersant that is wasted through evaporation or mis-targeting.

Nozzles 42 are provided chemical dispersant from a pump 44 located on vessel 26. Pump 44 receives the chemical dispersant from a tank 48 and pumps the chemical dispersant under pressure by way of conduit 50 along boom portion 32 to manifolds 66 of spraying section 41. In one embodiment, a Roper gear-type pump such as a pressure washer pump is used, although the present invention contemplates any type of pump capable of pumping a liquid to the nozzles. Some embodiments of the present invention also contemplate a second pump 45 receiving chemical dispersant from a tank 49 on second vessel 28 and providing the chemical dispersant under pressure through a conduit 51 along boom portion 34. Although what has been shown and described is a pump and tank located on the towing vessels, the present invention also contemplates a floating platform 41 constructed and arranged to house a suitable quantity of chemical dispersant, and also a pump and drive motor for pumping the dispersant under pressure.

In a preferred embodiment, the chemical dispersant is stored in tank 48 in a state that is substantially undiluted with water. By way of non-limiting example, the present invention contemplates the use of chemical dispersant such as Corexit 9500® and Corexit 9527®, manufactured by Exxon/Mobil. By providing undiluted dispersant to nozzles 42 it is possible to store a larger quantity of chemical dispersant in the vessel, and further to minimize the size and power requirements of the chemical conduit and pump. In one embodiment, the pump is powered by an internal combustion engine and the pressure and flow of the dispersant is controlled by the throttle of the engine. In yet another embodiment, there is a flow control system which includes a bypass valve controlled by an electronic controller. The present invention also contemplates those embodiments in which the undiluted chemical dispersant is provided at high pressure to nozzles 42. The present invention also contemplates those embodiments in which the chemical dispersant is stored diluted with water in a tank, or in which water is mixed with dispersant chemical as the dispersant chemical flows through an eductor. Further, the present invention also contemplates low pressure pumping of the chemical dispersant.

Some embodiments of the present invention include a second platform or mixing section 52 located aft of spraying section 41. Mixing section 52 agitates the combination of contaminant and chemical dispersant by creating turbulence and increases the subsequent dispersing of the contaminant. Preferably, the second platform 52 is towed behind the exit of the flow aperture of the boom and floating platform 41. In some embodiments, second platform or mixing section 52 is passive, and induces mixing of the sprayed dispersant and contaminant by creating turbulence as the water, contaminant, and sprayed dispersant flow over the mixing section. For example, a pallet-type structure, with a plurality of spaced apart boards oriented transverse to the flow through the aperture, provides suitable mixing as the various liquids flow over and around the spaced apart boards. A further example of passive mixer is a plastic sheet with a plurality of holes which is towed behind the floating platform 41. The mixing is induced by the turbulent flow of the liquids in and around the holes of the plastic sheet.

Yet other embodiments of the present invention contemplate active mixers with at least one moving component such as a rotating paddle wheel, rotating water screw, or rotating water propeller. In these embodiments, the rotating member turns as it and the floating platform 41 are towed by the vessels. The rotation of the device induces mixing of the various liquids passing through flowing aperture 40. In yet another embodiment of the present invention, the mixing section includes an active, powered device, such as a powered rotating paddle wheel, powered water screw, or powered water propeller. In these embodiments, the rotating device is driven by one or more small motors mounted to the second platform 52. Alternatively, the power to rotate the active mixer can be from a hydraulic motor which is powered by pressure in the hydraulic line which provides pressurized chemical dispersant to the nozzles.

Although what has been shown and described is a mixing section towed behind spraying section 41, the present invention also contemplates those embodiments in which either a passive mixing apparatus or an active mixing apparatus is incorporated into floating platform or spraying section 41. For example, a passive mixing apparatus such as a pallet-type object could be suspended between the lower portions of floating platform 41 sides 60 and 62. As yet another example, an active mixing apparatus such as a powered rotating power wheel could be rotatably coupled to the lower portion of the opposing sides 60 and 62.

The combination of chemical dispersant and contaminant exits from mixing section 52 and is released onto body of water 24. The present invention permits continuous processing of the contaminant. As contaminant is processed by being sprayed and mixed with chemical dispersant, other new, unprocessed contaminant is simultaneously concentrated and directed toward the nozzles, and previously processed contaminant is simultaneously released from the apparatus.

Figure 2:
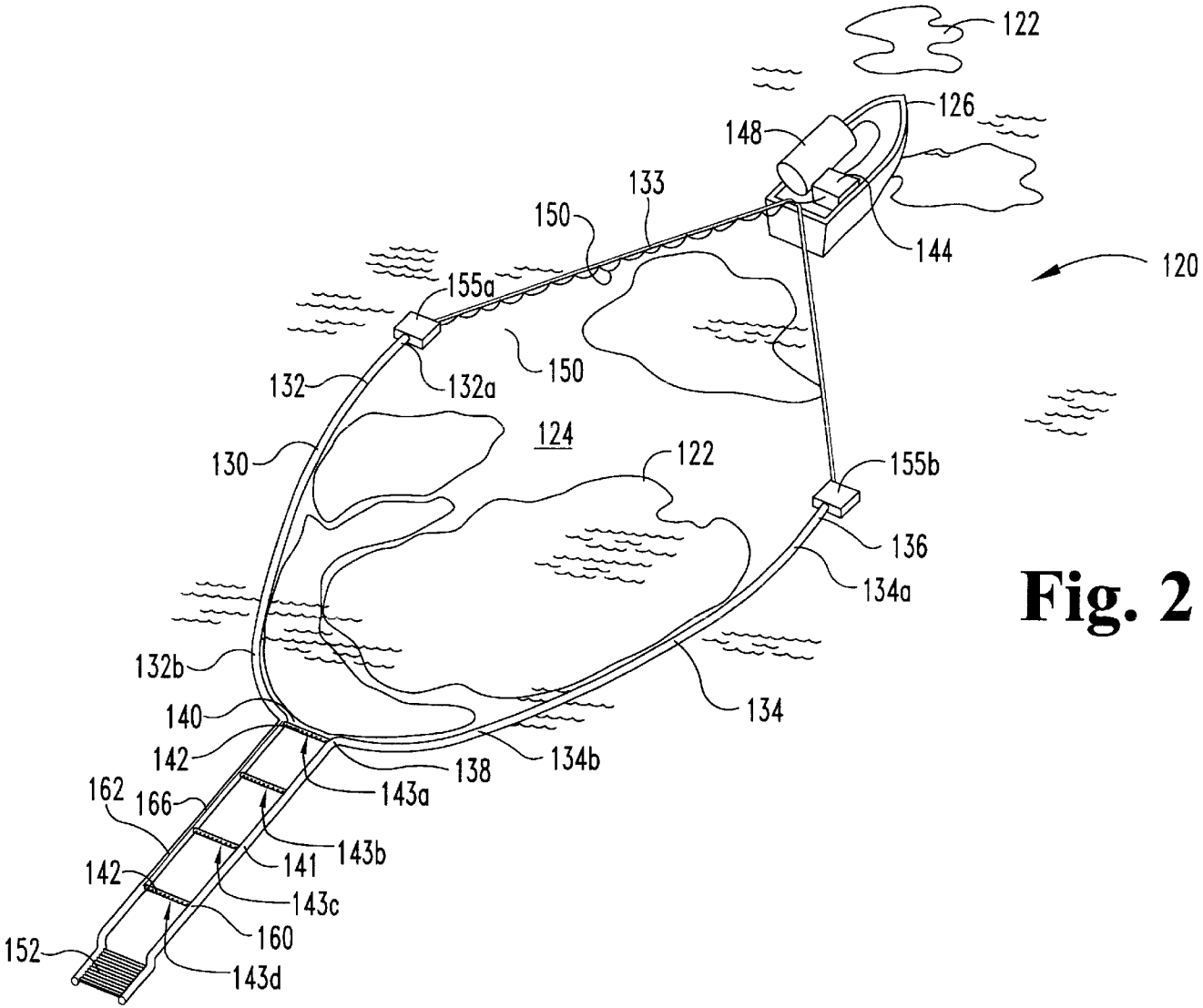
FIG. 2 is a view from above of another embodiment according to the present invention.

FIG. 2 shows a view from above of one embodiment of the present invention. The use of a one hundred series prefix (1XX) with an element number refers to an element that is the same as the non-prefix element (XX) previously depicted or described, except for the differences which are depicted or described hereafter. Apparatus 120 is the same as apparatus 20, except that only a single water vessel 126 tows boom 130 over body of water 24. Apparatus 120 includes a pair of planar boards 155*a* and 155*b* coupled to leading portions 132*a* and 134*a*, respectively. The rudder action of planar boards 155*a* and 155*b* maintains separation between leading portions 132*a* and 134*a* so as to provide an open end 136 into which contaminant is directed. Planar boards 155*a* and 155*b* preferably include a pair of planar members coupled to each other in parallel relationship with the front of one planar member being spaced in ahead of the front of the other planar member. Planar boards are known for enabling a boat to pull a device located away from the side of the boat. The planar board is constructed and arranged to steer itself away from the boat when pulled forward by the boat. As another example, a planar board assembly may include a pair of planar boards held in spaced relationship by linkage. Numerous examples of planar boards, such as those used during fishing, are discussed in U.S. Pat. No. 5,826,365 to Stroobants, and incorporated herein by reference.

Figure 5:
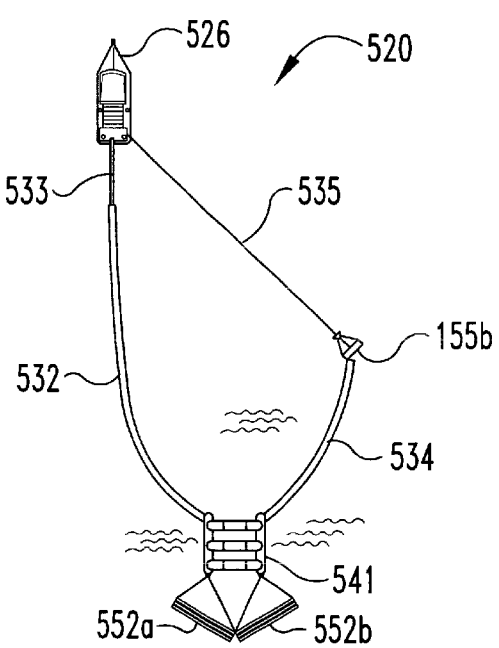
FIG. 5 is a view from above of another embodiment according to the present invention.
Figure 4:
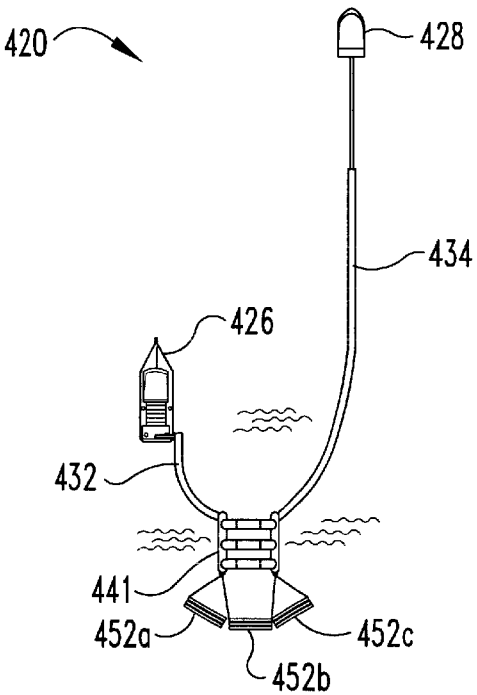
FIG. 4 is a view from above of another embodiment according to the present invention.
Figure 3:
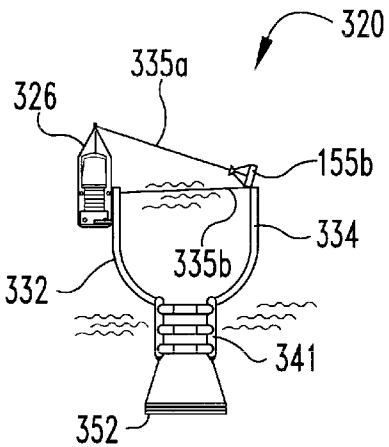
FIG. 3 is a view from above of another embodiment according to the present invention.

FIGS. 3, 4, and 5 all depict alternate embodiments of the present invention. The use of a three hundred series, four hundred series, or five hundred series prefix (3XX, 4XX, 5XX, respectively) with an element number refers to an element that is the same as the non-prefix element (XX) previously depicted or described, except for the differences which are depicted or described hereafter. Apparatus 320 is the same as apparatus 20, except boom portion 334 is directed through the water by a planar board 155*b* which is coupled to vessel 326 by both a flexible tension line 335*a* and a rigid spacing member 335*b*. Spacing member 335*b* maintains a generally fixed horizontal distance between planar board 155*b* and vessel 326. Tension line 335*a* connected to the bow of vessel 326 pulls planar board 155*b* through the water.

FIG. 4 depicts apparatus 420 which includes vessels 426 and 428 to which are connected different lengths of boom portions 432 and 434, boom portion 434 being longer than boom portion 432. The booms are connected to and from floating platform 441. In addition, a plurality of mixing apparatuses 452*a*, 452*b*, and 452*c* are towed behind floating platform 441. The plurality of second platforms or mixing sections 452*a*, 452*b*, and 452*c* provide improved mixing of liquids passing through the flow aperture.

FIG. 5 depicts apparatus 520 that includes asymmetrical boom portions 532 and 534. Boom portion 534 is shorter than boom portion 532. A surface vessel 526 tows boom portion 532 behind it by tension line 533. A second tension line 535 pulls in an angular manner on a planar board 155*b*. A pair of mixing sections 552*a* and 552*b* are towed behind floating platform 541.

Figure 6A:
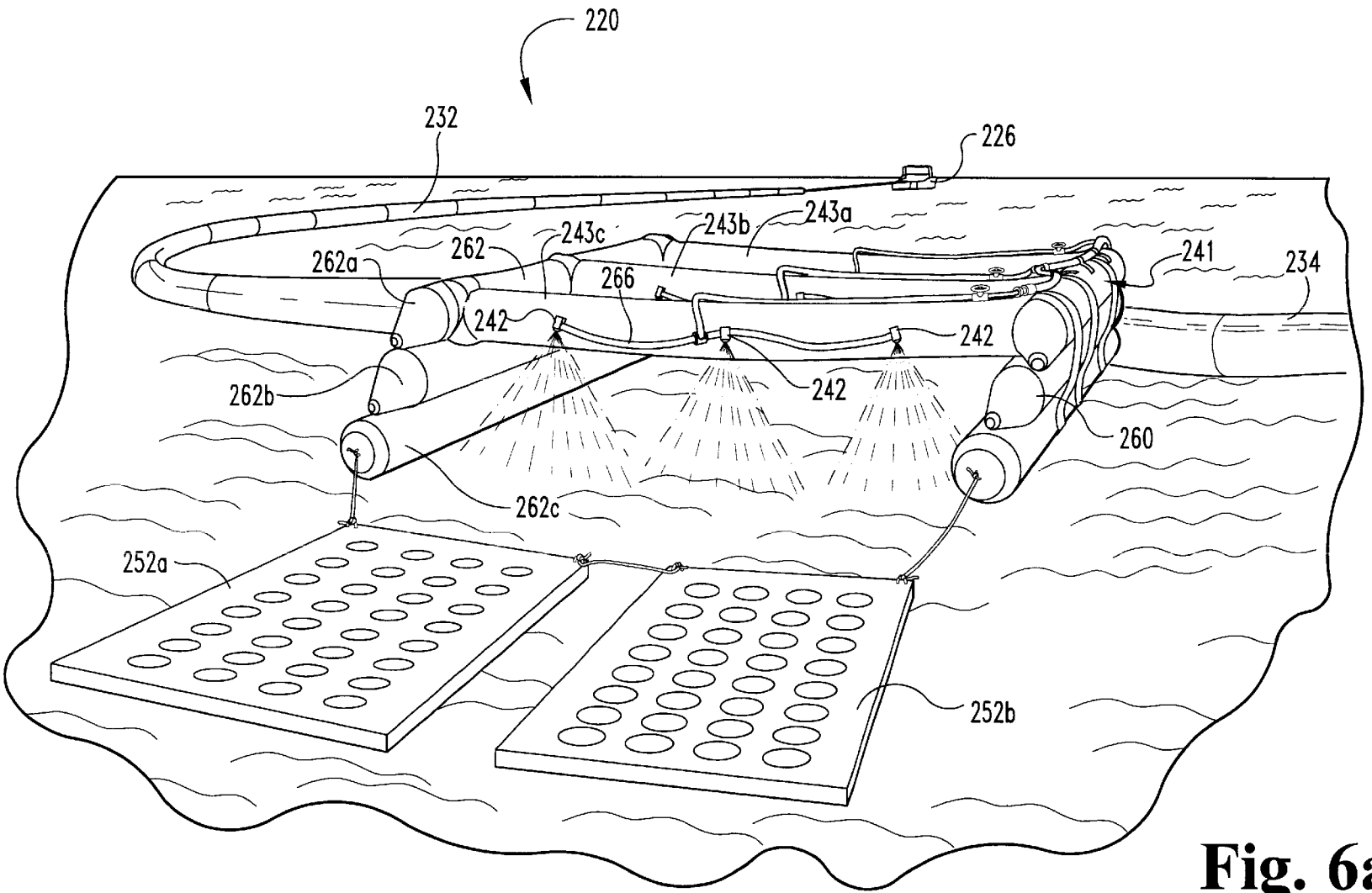
FIG. 6*a* is an aft perspective view looking forward of another embodiment according to the present invention.
Figure 6B:
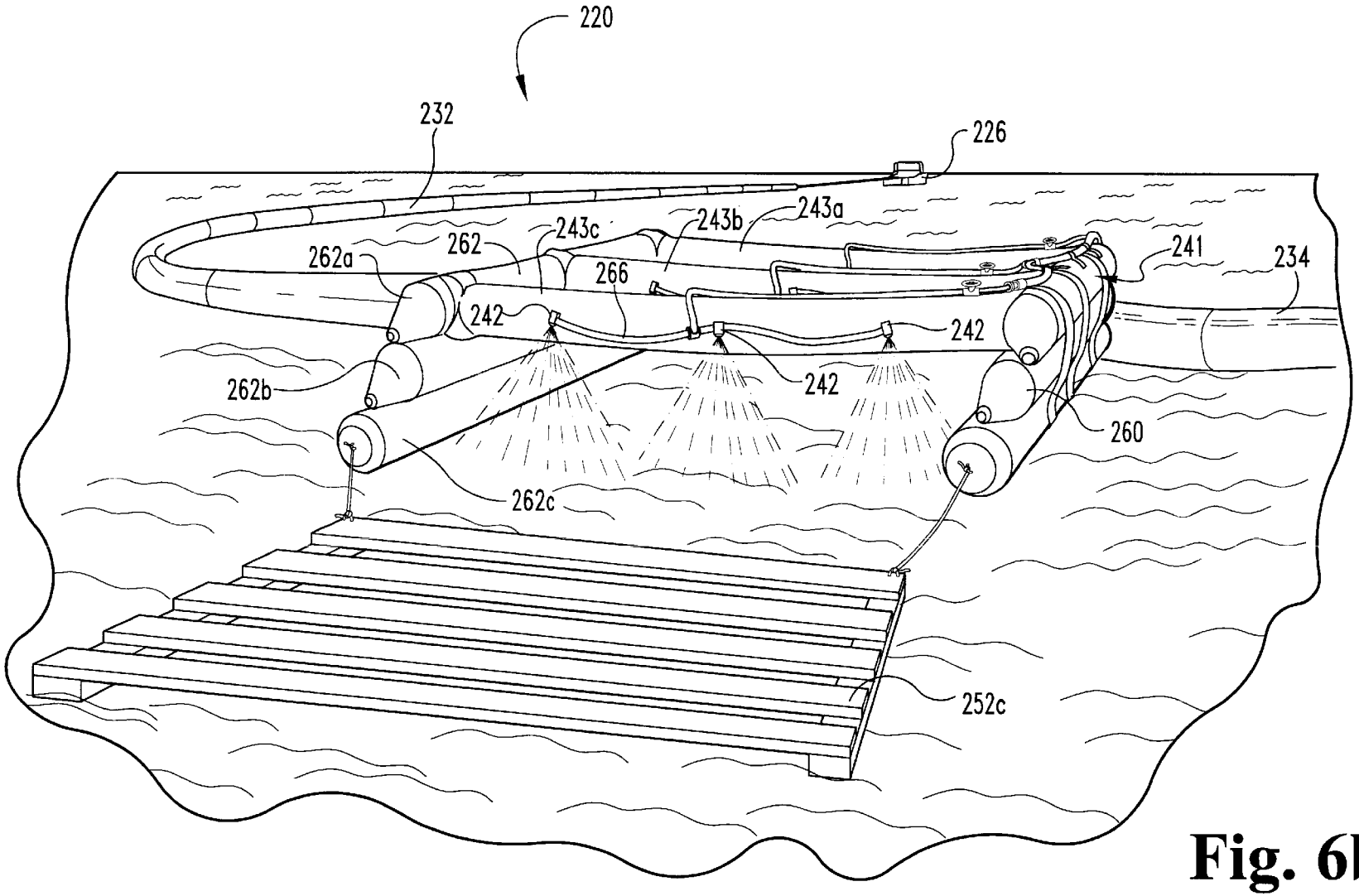
FIG. 6*b* is an aft perspective view looking forward of another embodiment according to the present invention.
Figure 7:
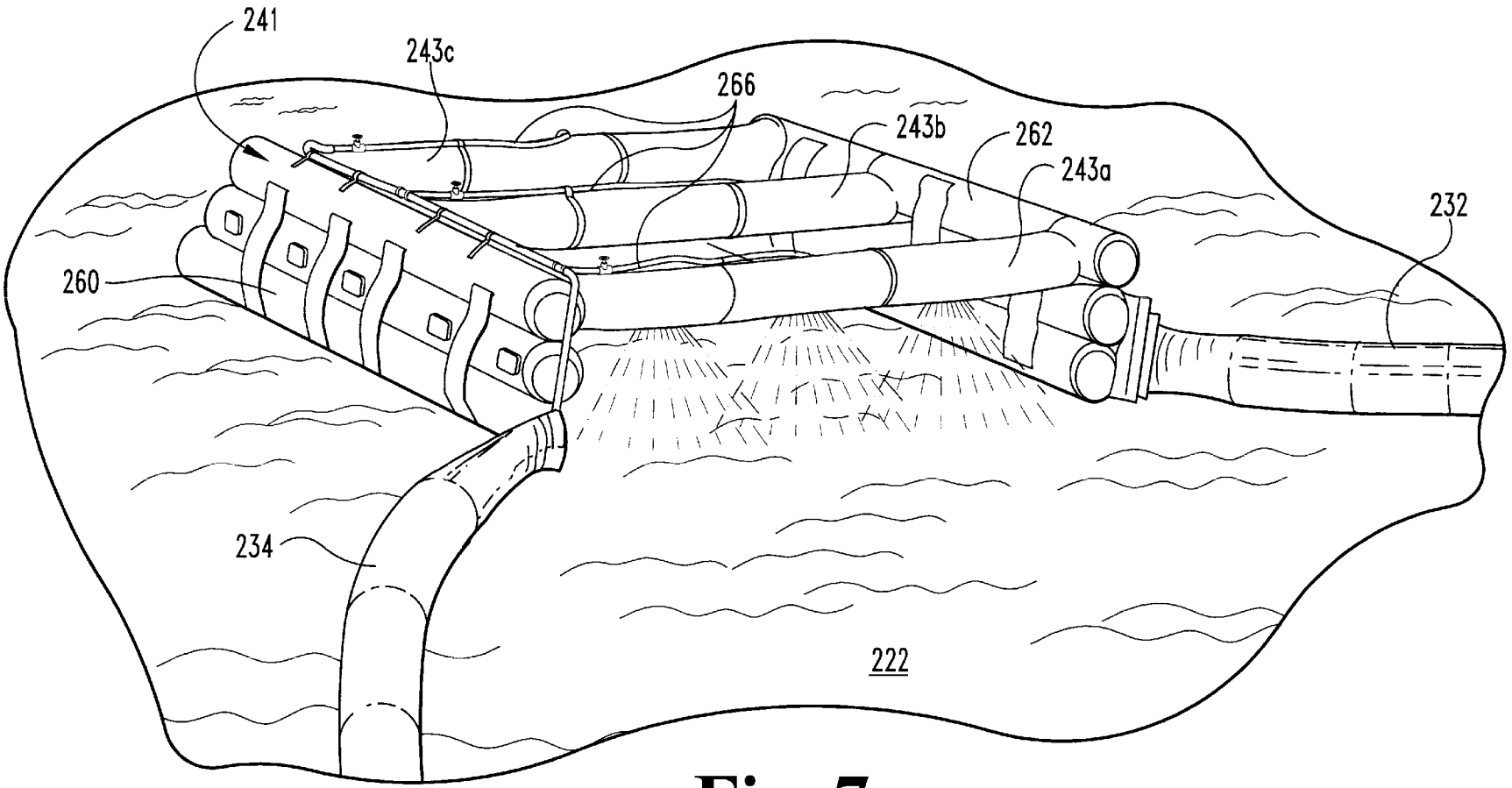
FIG. 7 is a forward perspective view looking aft of a portion of the invention of FIG. 6*a*.

Referring to FIGS. 6*a*, 6*b*, and 7, there is shown another embodiment according to the present invention. The use of a two hundred series prefix (2XX) with an element number refers to an element that is the same as the non-prefix element (XX) previously depicted or described, except for the differences which are depicted or described hereafter. Apparatus 220 is the same as apparatus 20, except with regards to floating platform 241. Floating platform 241 is comprised of opposing sides 260 and 262 which each include a plurality of inflatable members, such as member 262*a*, 262*b*, and 262*c*. These inflatable members are coupled together to provide buoyant support for the inflatable cross members 243*a*, 243*b*, and 243*c* which span the predetermined distance that sides 260 and 262 are spaced apart. As best seen in FIG. 6, each cross member includes a manifold 266 which provides a chemical under pressure to a plurality of spray nozzles 242. Floating platform 241 is approximately 10 feet wide and 12 feet long. However, those of ordinary skill in the art will recognize floating platform sections that are of different dimensions. In addition, the present invention contemplates sides of a floating platform 241 which is constructed with solid foam, rigid frame aluminum such as used in pontoon boats, and/or plastic pontoons.

FIG. 6*a* shows a pair of passive mixing sections 252*a* and 252*b* towed behind floating platform 241. Mixing sections 252*a* and 252*b* include a generally planar section of plastic with a plurality of large holes or open spaces. These holes help induce turbulence and mixing of the dispersant chemical, contaminant, and water as these materials flow in and around the various edges of the mixing sections 252*a* and 252*b*. FIG. 6*b* shows a passive mixing section 252*c* towed behind floating platform 241. Mixing section 252*c* includes a plurality of wooden planks constructed and arranged in a manner similar to that of a wooden shipping pallet. The shape and spacing of the planks help induce turbulence and mixing of the dispersant chemical, contaminant, and water as these materials flow in and around the planks of the mixing section 252*c*. The present invention contemplates mixing sections which include any of a variety of shapes that induce surface mixing of the materials exiting the flow channel of the floating platform.

One embodiment of the present invention includes a system for dispersing floating contaminant. The system includes a vessel for towing a boom, the boom having first and second portions, the first boom portion and the second boom portion forming an apex, the apex having an aperture. The system includes a chemical for treating the contaminant. The system includes a nozzle proximate the apex of the first and second boom portions for spraying the chemical on the contaminant. Towing of the boom concentrates the contaminant proximate the apex for spraying the chemical and the contaminant flows through the aperture.

Another embodiment of the present invention includes a method for dispersing floating contaminant. The method includes collecting a portion of contaminant from a body of water. The method includes directing the collected contaminant toward a nozzle. The method further includes spraying a chemical on the collected contaminant by the nozzle. The method additionally includes releasing the mixture of chemical and contaminant onto the body of water.

Another embodiment of the present invention includes a method for chemically treating a substance floating on a body of water. The method includes collecting a portion of the floating substance from the body of water. The method also includes spraying a chemical treatment on the collected floating substance by the nozzle and also includes releasing the mixture of chemical treatment and substance back onto the body of water.

Another embodiment of the present invention includes a towed apparatus for the water. The apparatus includes a floating platform having first and second opposing sides, the first and second sides being spaced apart and forming a flow channel therebetween for passage of water therethrough. The apparatus provides a cross member connecting the first and second sides, the cross member being placed above the level of the water. The apparatus additionally includes a plurality of spray nozzles attached to the cross member, the nozzles directed downward at least in part for spraying a chemical toward the surface of the water.

Another embodiment of the present invention involves a method for treating floating contaminant. The method includes storing a chemical in a boat and towing on a body of water a floating boom and a floating nozzle behind the boat. The method further includes pumping the chemical from the boat to the nozzle with the nozzle spraying the chemical on the floating contaminant.

Another embodiment of a method of the present invention for dispersing floating contaminant includes storing chemical dispersant in a boat and towing a pair of booms and a nozzle behind the boat. The booms are used to form a flow aperture. The method further includes spraying the chemical dispersant by the nozzle on the floating contaminant proximate the aperture.

Another embodiment of the present invention is a method for dispersing floating contaminant which involves providing a boat, a floating platform having a flow aperture and spray nozzle, and a supply of chemical dispersant. The method includes towing the floating platform behind the boat and guiding the floating contaminant through the aperture. The method further involves spraying the chemical dispersant on the floating contaminant proximate the aperture by the nozzle.

Still another embodiment of the present invention includes a method for dispersing floating contaminant which involves providing a boat, a separate floating platform having a spray nozzle, and a supply of chemical dispersant. The method further includes towing the floating platform behind the boat and distributing the chemical dispersant on the floating contaminant by the nozzle. The method also includes mixing the sprayed dispersant and the floating contaminant.

Still a further embodiment of the invention is a method for dispersing contaminant on a body of water which includes storing chemical dispersant in a boat. The method includes towing a boom and a nozzle behind the boat, and forming the boom with an open end and an apex forming a flow aperture by the boom proximate the apex. The method also includes collecting a portion of contaminant floating on the body of water by the boom and concentrating the floating contaminant toward the apex by towing the boom by the open end. The method also includes directing the collected floating contaminant toward the nozzle and pumping the chemical dispersant from the boat to the nozzle. Also included in the method is spraying the chemical dispersant on the collected contaminant by the nozzle. The method further includes mixing together the sprayed dispersant and the collected contaminant and releasing the mixture of dispersant and contaminant through the aperture onto the body of water.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A system for dispersing floating contaminant comprising:

a vessel for towing a boom, said boom having first and second portions, said first boom portion and said second boom portion forming an apex, the apex having an aperture;

a chemical for dispersing the contaminant;

a nozzle proximate the apex of said first and second boom portions for spraying said chemical on the contaminant; and wherein the towing of said boom concentrates the contaminant proximate the apex for spraying said chemical, and the contaminant flows through the aperture.

2. The system of claim 1 which further comprises a plurality of nozzles proximate the apex.

3. The system of claim 1 which further comprises a mixer for mixing said sprayed chemical and the contaminant.

4. The system of claim 1 which further comprises a pump for providing a flow of said chemical to said nozzle.

5. The system of claim 1 wherein said chemical is substantially undiluted with water.

6. The system of claim 1 wherein said first and second boom portions form an open end generally opposite of the apex, and towing of said boom by the open end concentrates said chemical toward the apex.

7. A method for dispersing floating contaminant comprising:

collecting a portion of contaminant from a body of water;

directing the collected contaminant toward a nozzle;

spraying a dispersant on the collected contaminant by the nozzle; and releasing the mixture of dispersant and contaminant onto the body of water;

wherein said directing is by towing a pair of booms and forming an apex by the booms.

8. The method of claim 7 which further comprises mixing the dispersant and contaminant before said releasing.

9. The method of claim 7 wherein said collecting is by at least one vessel towing a boom assembly.

10. The method of claim 7 wherein said collecting is by skinning the surface of a body of water.

11. The method of claim 10 wherein said skimming is by a water vessel towing a boom.

12. The method of claim 7 wherein said directing is by towing a pair of booms by a water vessel.

13. A towed apparatus for water comprising:

a floating platform having first and second opposing sides, said first and second sides being spaced apart by a predetermined distance and forming a flow channel therebetween for passage of water therethrough;

a cross member connecting said first and second sides and spanning the predetermined distance, said cross member being placed above the level of the water; and a plurality of spray nozzles attached to said cross member, said nozzles directed downward at least in part for spraying a liquid toward the surface of the water.

14. The apparatus of claim 13 wherein said floating platform is a first floating platform, and which further comprises a second floating platform towed behind said first floating platform, said second floating platform having an irregular surface for mixing the sprayed liquid near the surface of the water.

15. The apparatus of claim 13 which further comprises a pump for pressurizing the liquid and a manifold in fluid communication with said pump and said plurality of nozzles for providing the pressurized liquid to said plurality of spray nozzles.

16. The apparatus of claim 13 wherein said cross member is a first cross member, said plurality of nozzle is a first plurality of nozzles, and which further comprises a second plurality of nozzles and a second cross member spanning the predetermined distance, said second cross member being placed above the level of the water and spaced apart from said first cross member, said second plurality of nozzles being attached to said second cross member.

17. A method for dispersing floating contaminant comprising:

storing chemical dispersant in a boat;

towing a pair of booms and a nozzle behind the boat;

forming a flow aperture by the booms;

directing the floating contaminant between the booms and toward the aperture; and spraying the chemical dispersant on the floating contaminant proximate the aperture by the nozzle.

18. The method of claim 17 which further comprises forming the boom with an open end and an apex.

19. The method of claim 18 which further comprises concentrating the floating contaminant toward the apex by towing the boom by the open end.

20. The method of claim 17 which further comprises releasing the mixture of dispersant and contaminant through the aperture onto the body of water.

21. A method for dispersing floating contaminant comprising:

providing a boat, a floating platform having a flow aperture and spray nozzle, and a supply of chemical dispersant;

towing the floating platform behind the boat;

directing the floating contaminant through the aperture; and spraying the chemical dispersant on the floating contaminant proximate the aperture by the nozzle.

22. The method of claim 21 which further comprises mixing together the sprayed dispersant and the collected contaminant.

23. The method of claim 22 which further comprises releasing the mixture of dispersant and contaminant through the aperture onto the body of water.

24. The method of claim 21 wherein said directing is by skimming the surface of the body of water.

25. A method for dispersing floating contaminant comprising:

providing a boat, a separate floating platform having a spray nozzle, and a supply of chemical dispersant;

towing the floating platform behind the boat;

spraying the chemical dispersant on the floating contaminant by the nozzle; and mixing the sprayed dispersant and the floating contaminant.

26. The method of claim 25 wherein said providing includes a mixing apparatus, said mixing is by the mixing apparatus, and which further comprises towing the mixing apparatus behind the floating platform.

27. The method of claim 25 which further comprises collecting a portion of contaminant floating on the body of water and directing the portion toward the floating platform.

28. The method of claim 25 wherein the floating platform includes a water flow aperture and which further comprises releasing the mixture of dispersant and contaminant through the aperture onto the body of water.

29. A method for dispersing contaminant on a body of water, comprising:

storing chemical dispersant in a boat;

towing a boom and a nozzle behind the boat;

forming the boom with an open end and an apex;

forming a flow aperture by the boom proximate the apex;

collecting a portion of contaminant floating on the body of water by the boom;

concentrating the floating contaminant toward the apex by towing the boom by the open end;

directing the collected floating contaminant toward the nozzle;

pumping the chemical dispersant from the boat to the nozzle;

spraying the chemical dispersant on the collected contaminant by the nozzle;

mixing together the sprayed dispersant and the collected contaminant; and releasing the mixture of dispersant and contaminant through the aperture onto the body of water.

* * * * *

UNITED STATES PATENT AND TRADEMARK OFFICE

CERTIFICATE OF CORRECTION

PATENT NO. : 6,517,726 B2 
DATED : February 11, 2003
INVENTOR(S) : Alan A. Allen et al.

It is certified that error appears in the above-identified patent and that said Letters Patent is hereby corrected as shown below:

Column 10,
Line 16, please delete the word “skinning” and insert in lieu thereof -- skimming --.

Signed and Sealed this

Eleventh Day of November, 2003

JAMES E. ROGAN
*Director of the United States Patent and Trademark Office*